US006126392A

United States Patent [19]

Sabini

[11] Patent Number: 6,126,392

[45] Date of Patent: Oct. 3, 2000

[54] INTEGRAL PUMP/ORIFICE PLATE FOR IMPROVED FLOW MEASUREMENT IN A CENTRIFUGAL PUMP

[75] Inventor: Eugene P. Sabini, Skaneateles, N.Y.

[73] Assignee: Goulds Pumps, Incorporated, Seneca Falls, N.Y.

[21] Appl. No.: 09/072,973

[22] Filed: May 5, 1998

[51] Int. Cl.[7] ..... F04D 29/00

[52] U.S. Cl. ..... 415/118

[58] Field of Search ..... 415/118, 26, 47, 415/49, 212.1, 208.1, 211.1; 73/861.52, 861.59, 861.63

[56] References Cited

U.S. PATENT DOCUMENTS

| | | | |
|---|---|---|---|
| 3,662,599 | 5/1972 | Masnik | 73/205 D |
| 3,669,812 | 6/1972 | Masnik | 73/205 D |
| 3,759,098 | 9/1973 | Logsdon et al. | 73/205 R |
| 4,406,161 | 9/1983 | Locke et al. | 73/118 |
| 4,781,536 | 11/1988 | Hicks | 417/12 |
| 4,789,301 | 12/1988 | Osborne et al. | 415/206 |
| 5,129,264 | 7/1992 | Lorenc | 73/861.42 |
| 5,295,790 | 3/1994 | Bossart et al. | 417/43 |

*Primary Examiner*—Edward K. Look
*Assistant Examiner*—Rhonda Barton
*Attorney, Agent, or Firm*—Brezina & Ehrlich

[57] ABSTRACT

An improved centrifugal pump having an integral pump/orifice plate located at either the pump discharge nozzle or suction nozzle for improved fluid flow measurements through the pump casing, and a process for measuring fluid flow through such a centrifugal pump casing is disclosed wherein the static pressure of a fluid being pumped by the pump is measured at a first point in the inlet or outlet area of the pump and at a second point removed along the nozzle, the pressures are compared to a pre-determined flow constant of the casing.

28 Claims, 2 Drawing Sheets

INTEGRAL PUMP/ORIFICE PLATE FOR IMPROVED FLOW MEASUREMENT IN A CENTRIFUGAL PUMP

The invention relates to centrifugal pumps adapted for measuring the flow of fluids therethrough and more particularly to a specially designed integral pump/orifice plate located at either the pump discharge nozzle or suction nozzle for improved fluid flow measurements through a centrifugal pump.

BACKGROUND OF THE INVENTION

The measurement of fluid flow through a centrifugal pump with convenient read-out of repeatable accuracy has generally been a difficult process and typically requires the attachment of sensors and instrumentation downstream of the pump. At the same time, there is a demand for a simple, effective and reliable means for measuring fluid flow at the pump itself. A typical centrifugal pump of the prior art comprises an impeller rotatably mounted in a stationary casing, with the rotating impeller imparting pressure and kinetic energy to the fluid being pumped, with the stationary casing guiding the fluid to and from the impeller. In a typical centrifugal pump casing, which generally includes concentric, diffusor and volute type centrifugal casings, the rotation of the impeller imparts kinetic energy to the fluid and causes fluid flow, in a generally circular direction about the perimeter of the impeller, through the casing surrounding the impeller. At some point in the casing, the fluid flows from the perimeter of the impeller, passes a cut-water or the like, flows through an area of the pump generally known as the discharge inlet area and flows through the discharge nozzle to the pump discharge outlet.

In the operation of the pump, the fluid flow can be affected by the design of the impeller, the design and size of the casing, the speed at which the impeller rotates, the design and size of the pump inlet and outlet, quality of finish of the components, presence of a casing volute and the like. The incorporation of flow measurement devices within the pump are typically seen as creating added obstruction to fluid flow and further flow variations.

U.S. Pat. No. 5,129,264, Centrifugal Pump with Flow Measurement, discloses an improved pump casing and process for measuring fluid flow through a centrifugal pump casing wherein the static pressure of a fluid being pumped by the pump is measured at a first point in the pump discharge inlet area of the pump adjacent the flow arm of the pump and at a second point removed along the nozzle, the measured pressures are compared to a pre-determined flow constant of the casing. However, in some pump designs the nozzles or other hydraulic passage areas do not diverge enough to give a measurable differential pressure reading.

The principal object of this invention is to provide a centrifugal pump adapted for measuring fluid flow where the internal area changes are not great enough to provide meaningful flow measurements, thereby eliminating the need for a separate flow measuring device. This and other objects of the invention will become apparent from the following.

SUMMARY OF THE INVENTION

It has been found that centrifugal pumps generally demonstrate what can be termed a "flow constant", that is, a generally constant numerical value related to fluid flow which is particular to the size and design of the casing, impeller and impeller rotational speed. It has also been found that once established for a particular impeller and impeller rotational speed, the flow constant of a pump casing can be conveniently used to measure fluid flow through the pump by comparison of pressure differentials at select locations in the pump regardless of downstream restrictions.

According to the present invention there is provided a process for measuring fluid flow through a centrifugal pump casing wherein an impeller turning at generally constant speed pumps fluid through a casing past a cut-water and a pump discharge inlet area, through a pump discharge nozzle to a discharge outlet comprising: determining the flow constant of the pump casing containing the impeller turning at the constant speed; measuring the pressure head of a fluid being pumped by the pump at a first point in the pump discharge inlet area; measuring the pressure head of a fluid being pumped by the pump at a second point, spaced from the pump discharge inlet area, in the discharge nozzle; and, comparing the differential in pressure head between the first point and the second point with the flow constant.

The invention further provides an improved fluid flow measuring centrifugal pump having a casing, a suction inlet, a driving shaft, a centrifugal impeller mounted on the shaft within the casing, a cut-water, a pump discharge inlet area, a discharge outlet communicating with the pump discharge inlet area through a discharge nozzle, first pressure head sensing means in the pump inlet discharge area, second pressure head sensing means in the discharge nozzle, and means for comparison of data from the pressure sensing means with a flow constant, the improvement comprising an integral orifice plate at either the pump discharge or suction nozzle to measure flow in pumps where the internal area changes are not great enough to provide meaningful flow measurements.

The nature, principles and details of the invention as well as other objects and features thereof, will be more clearly apparent from the following description taken in connection with the accompanying drawings in which like parts are designated by like reference characters.

DETAILED DESCRIPTION OF THE INVENTION

Figure 1:
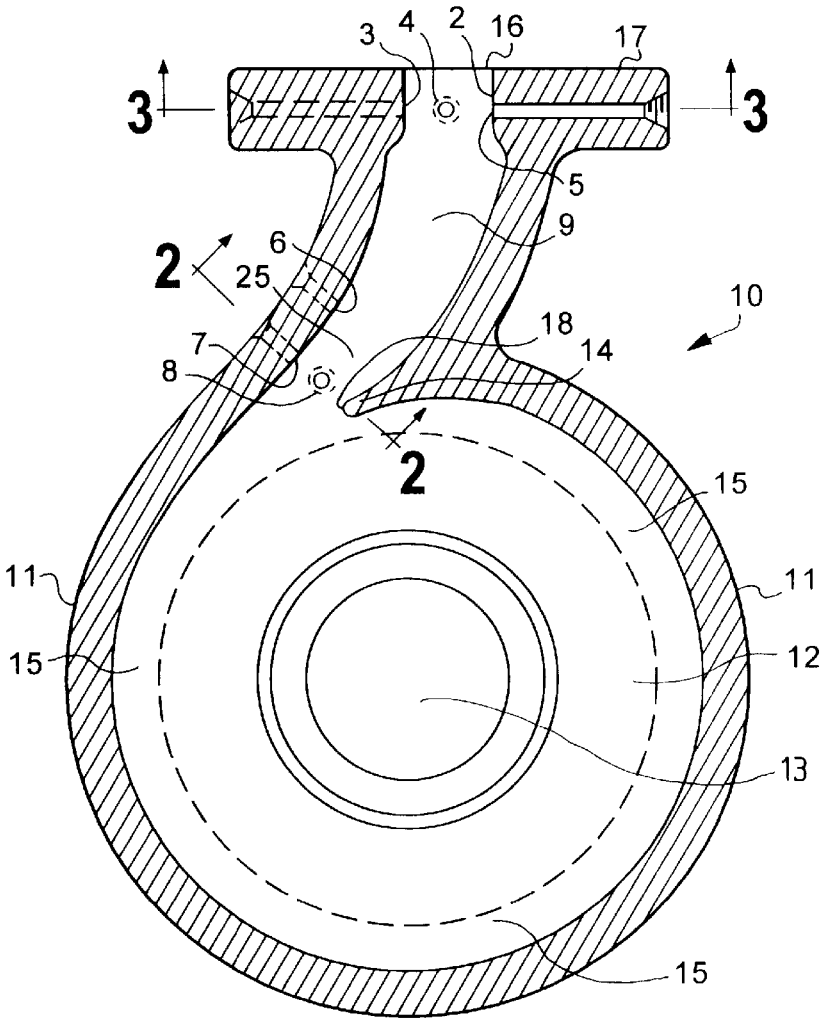
FIG. 1 is a sectional view of a centrifugal pump of the invention.

Referring now to FIG. 1, therein is shown a pump 10 having a pump casing 11, an impeller 12, an impeller drive shaft 13 which is connected to a drive motor (not shown), a cut-water 14, a casing volute 15, a discharge nozzle 9, a pump discharge outlet 16 and a pump outlet attachment flange 17 to which is attached an integral orifice plate 2. Adjacent the cut-water 14 are sensor taps 6, 7 and 8, with taps 6 and 7 being positioned about opposite the cut-water 14. Sensor taps 7 and 8 are disposed on about a 90 degree plane to the longitudinal axis of the casing volute 15 at a leading edge 18 of the cut-water 14 in the portion of the casing generally termed pump discharge inlet area 25. The pump discharge inlet area 25 comprises an area of the casing starting in the casing volute beginning before about cut-water leading edge 18 and extending beyond the cut-water to the area of the casing generally known as the discharge nozzle. The precise boundaries of the pump discharge inlet area can change depending upon the size and design of the pump but can be generally defined, for purposes of this invention, as that area adjacent the cut-water, within which a pressure head can be measured which, when compared to a pressure head spaced therefrom outside the pump discharge inlet area, along the discharge nozzle, will respond to changes in flow rate with changes in head pressure that follow a generally predictable mathematical relationship.

Sensor taps 3, 4 and 5 are displaced along the discharge nozzle 9 from taps 6, 7 and 8, beyond the pump discharge inlet area 25, toward the pump discharge outlet 16 and the integral orifice plate 2. Tap 4 is in the same side of the casing as tap 8, tap 3 is in an opposite side of the casing as the cut-water 14 and tap 5 is in an opposite side of the casing as taps 6 and 7. Tap 6 is disposed in the casing at a point in the pump discharge inlet area 25 spaced from taps 7 and 8. The presence of the integral orifice plate 2 overcomes the problem of hydraulic passage areas that do not diverge enough to give a measurable differential pressure reading.

The sensor taps are presented in the figures as passages through which fluid can flow for measurement of the pressure head at a position in the pump casing. It should be understood, that the illustration of sensor tap passages in the drawings is merely meant to be representative of positions of measurement for convenient explanation in accordance with the invention. Any appropriate sensing means, which are suitable to designate pressure, may be used in conjunction with the representative positions. Thus, sensing means in accord with the invention includes a passage through which fluid flows to remote or included instrumentation for pressure designation and the like, as well as electronic, mechanical or the like sensing means installed at the position of the passage that provides data to remote or included instrumentation or the like.

Figure 2:
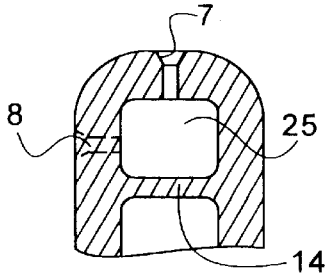
FIG. 2 is an enlarged fragmentary section of the centrifugal pump of FIG. 1 taken along about line 2—2.

FIG. 2, is a fragmentary section along about line 2—2 of FIG. 1, showing the relative position of sensor taps 7 and 8 to each other and to the cut-water 14.

Figure 3:
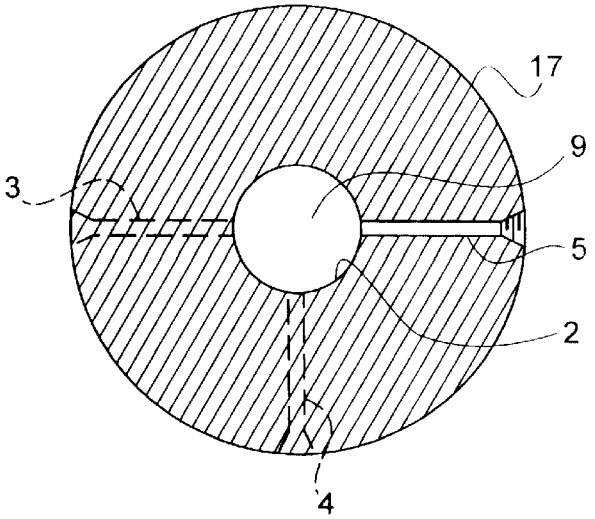
FIG. 3 is a sectional of the centrifugal pump of FIG. 1 taken along about line 3—3.

FIG. 3 is a top section along about line 3—3 of FIG. 1, illustrating the relative position of sensor taps 3, 4 and 5 to each other and to the integral orifice plate 2 on the pump outlet attachment flange 17.

Figure 4:
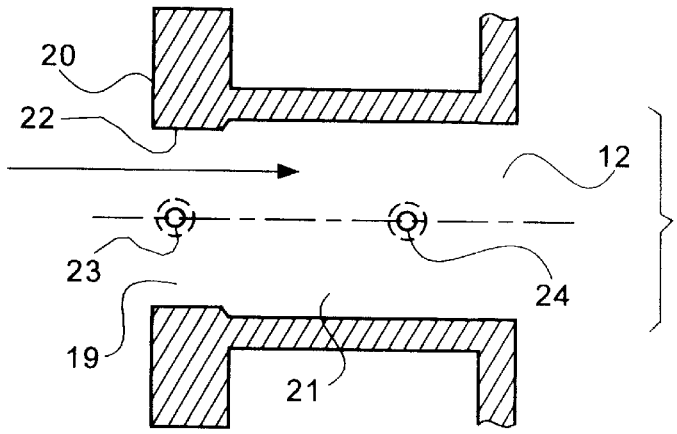
FIG. 4 is a fragmentary sectional view of an inlet of a centrifugal pump of the invention.

FIG. 4, is a fragmentary section of a pump inlet 19 of the centrifugal pump of FIG. 1. Therein, the pump casing comprises an inlet passage 21 and a pump inlet attachment flange 20 to which is attached an integral orifice plate 22 wherein fluid flows a 5 in the direction of the arrow to the impeller 12. Sensor taps 23 and 24 are spaced from each other, with tap 23 being positioned in the inlet attachment flange 20 and tap 24 being positioned in the inlet passage 21.

In comparative testing of the invention, the inlet of the centrifugal pump of FIG. 1 was connected to a fluid reservoir. The outlet was connected to a commercial fixed Venturi tube head meter which in turn was connected through a variable flow valve back to the reservoir. Input and output to the reservoir was at the same fluid level within the reservoir. The pump was activated to a predetermined impeller speed and allowed to come to a steady state of pumping efficiency with the valve fully open. The valve was then restricted to control fluid flow therethrough to various actual flow rates as determined by differential pressure calculation obtained at the fixed Venturi tube head meter in accordance with a standard commercial method supplied by the manufacturer of the Venturi tube head meter. In accordance with such method, calculation of the actual flow (Q) of the pump was determined by using the formula:

$$Q=K(\sqrt{\Delta P})$$

wherein Q is the volume rate of flow in gallons per minute (gpm); K is the meter constant which was supplied by the manufacturer of the Venturi meter; and, ΔP is the differential head in feet of fluid flowing through the Venturi meter.

Figure 5:
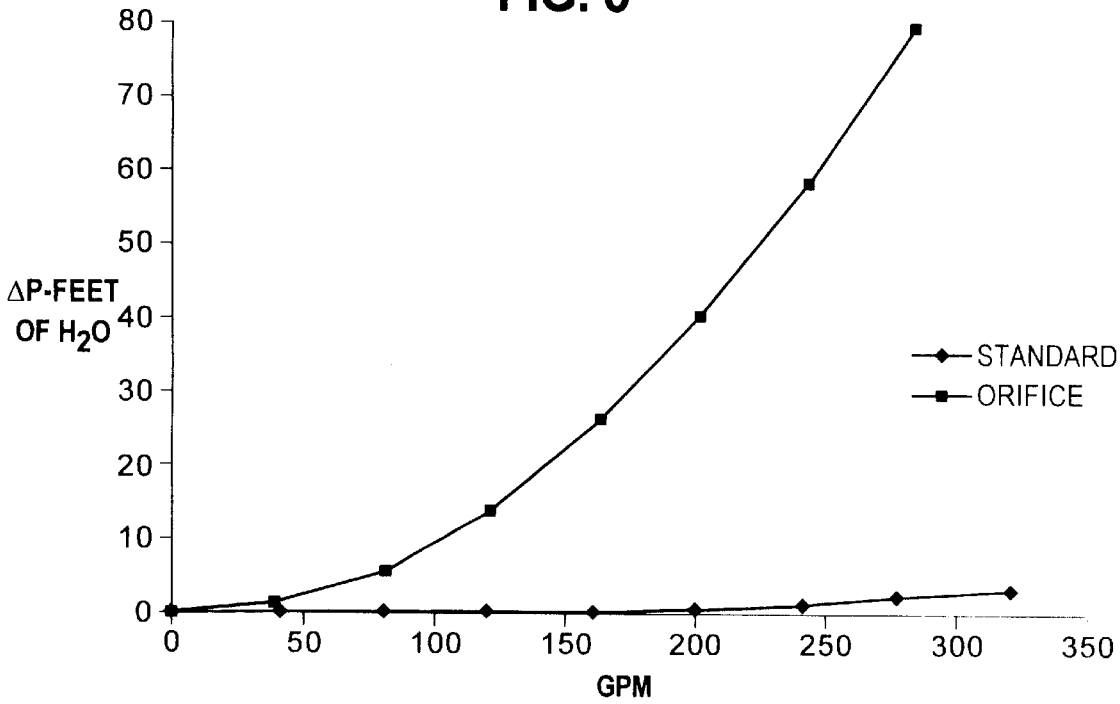
FIG. 5 is a graph of experimental data showing fluid flow through a pump with an orifice plate plotted against data showing fluid flow through a pump without an orifice plate.

The pressure head differential between various of taps 3–8 and 23 and 24 was measured coincidentally with the differential pressure flowing through the Venturi meter, by means of a manometer connected at the various taps, at the various flow rates. FIG. 5 is a graph of the square root of pressure differentials obtained coincidentally between select taps in a centrifugal pump with an integral pump/orifice plate, as compared against flow rates obtained from a centrifugal pump without an integral pump/orifice plate, at an impeller speed of 3550 RPM. As can be seen, the square root of pressure differentials between taps in a centrifugal pump with an integral pump/orifice plate provides a generally linear relationship with actual fluid flow. The data from a centrifugal pump without an integral pump/orifice plate shows very low pressure differentials which indicates limited utility for easily measuring fluid flow.

The generally linear relationship in the square root of pressure differential between taps in a centrifugal pump with an integral pump/orifice plate as compared to actual flow generally follows the mathematical expression:

$$Q=K(\sqrt{\Delta P})+C$$

wherein Q is rate of fluid flow; K is the pump flow constant; ΔP is the differential pressure between taps; and C is a correction factor. Using the actual flow rate and the actual pressure differentials from various taps, pump flow constants and correction factors were calculated for the pump at various impeller RPM's.

The following polynomial formulas were used to directly calculate fluid flow rate for the pump at various RPM's within an accuracy of about 2% at a flow rate of from about 20% to about 125% of the Best Efficiency Point (BEP) flow of the pump. At an 1800 RPM impeller speed a suitable polynomial formula was found to be $Q=18.99964\ (\sqrt{\Delta P})+5.529$; at 3600 RPM, $Q=17.9399\ (\sqrt{\Delta P})+15.656$; and at 5400 RPM, $Q=16.9374\ (\sqrt{\Delta P})+25.951$.

It should be understood that the above formulas are merely examples of typical formulas that might use the differential pressure data for ascertaining fluid flow and that the invention is not limited thereto.

The positioning of the sensor taps is significant to obtaining adequate differential pressure data for convenient and accurate measurement of fluid flow in the centrifugal pump. It has been found that when a first tap is positioned in the pump discharge inlet area, adjacent about the cut-water, and a second tap is spaced therefrom along the discharge nozzle, a generally linear relationship between fluid flow and the square root of the pressure head differential can be established which has sufficient pressure differential for convenient measurement. In a preferred embodiment a first tap would be positioned in the pump discharge inlet area adjacent about the leading edge of the cut-water and a second tap positioned in the discharge nozzle at about the integral orifice plate.

In the positioning of differential pressure taps, particularly for the passage of fluid to a pressure sensor, it has been found preferable that the passageways be aligned at a right angle to the casing surface at its position in the discharge inlet area or discharge nozzle. Such alignment appears to reduce the effect of changes in fluid velocity within the casing as a component of the pressure head at the passageway and generally provides improved accuracy for determining fluid flow. Generally, it is also preferable to position such taps at opposing sides of the casing along the curvature of the volute as shown for taps 5 and 7 to maximize the head pressure differential.

We claim:

1. In a process for measuring fluid flow through a centrifugal pump comprising a pump casing, an impeller constructed and arranged to turn at a substantially constant speed, and a suction nozzle inlet, a cut-water, a pump discharge inlet area, a pump discharge nozzle and a discharge outlet forming a fluid flow circuit through which fluid is pumped, wherein the process comprises:

measuring pressure head for the fluid being pumped at a first point in the pump discharge inlet area;

measuring pressure head of the fluid being pumped at a second point spaced from the discharge inlet area, in the discharge nozzle; and computing a difference in pressure head between the first point and the second point, and utilizing the difference and a pump flow constant to determine fluid flow;

and wherein the difference is pressure head is insufficient to reliably determine fluid flow;

the improvement comprising disposing an integral orifice plate at the pump discharge nozzle, the integral orifice plate being of reduced diameter and increasing the difference by an amount sufficient to reliably determine fluid flow.

2. The process of claim 1, wherein the pump flow constant comprises a factor that generally equates a known restricted flow rate of a fluid through the pump casing with the square root of the measured pressure difference, wherein the square root of the pressure difference is factored with the pump flow constant and a correction factor to measure fluid flow in accordance with a mathematical expression $Q=K(\sqrt{\Delta P})+C$, where Q is fluid flow rate, K is a pump flow constant, $\Delta P$ is the pressure difference and C is a correction factor.

3. The process of claim 2, wherein the known restricted flow rate is measured externally of the pump casing.

4. The process of claim 1, wherein the first and second points comprise sensor taps.

5. The process of claim 4, wherein the sensor taps comprise fluid pressure sensors.

6. The process of claim 4, wherein the sensor taps comprise passages for flow of fluid from the pump discharge inlet area and discharge nozzle.

7. The process of claim 1, wherein pressure difference between the first and second points is directly measured.

8. In a process for measuring fluid flow through a centrifugal pump comprising a pump casing, an impeller constructed and arranged to turn at a substantially constant speed, and a suction nozzle inlet, a cut-water, a pump discharge inlet area, a pump discharge nozzle and a discharge outlet forming a fluid flow circuit through which fluid is pumped, wherein the process comprises:

measuring pressure head for the fluid being pumped at a first point in the pump discharge inlet area;

measuring pressure head of the fluid being pumped at a second point spaced from the discharge inlet area, in the discharge nozzle; and computing a difference in pressure head between the first point and the second point, and utilizing the difference and a pump flow constant to determine fluid flow;

and wherein the difference is pressure head is insufficient to reliably determine fluid flow;

the improvement comprising disposing an integral orifice plate at the suction nozzle inlet, the integral orifice plate being of reduced diameter and increasing the difference by an amount sufficient to reliably determine fluid flow.

9. The process of claim 8, wherein the pump flow constant comprises a factor that generally equates a known restricted flow rate of a fluid through the pump casing with the square root of the measured pressure difference, wherein the square root of the pressure difference is factored with the pump flow constant and a correction factor to measure fluid flow in accordance with a mathematical expression $Q=K(\sqrt{\Delta P})+C$, where Q is fluid flow rate, K is a pump flow constant, $\Delta P$ is the pressure difference and C is a correction factor.

10. The process of claim 9, wherein the known restricted flow rate is measured externally of the pump casing.

11. The process of claim 8, wherein the first and second point comprise sensor taps.

12. The process of claim 11, wherein the sensor taps comprise fluid pressure sensors.

13. The process of claim 11, wherein the sensor taps comprise passages for the flow of fluid through the suction nozzle.

14. The process of claim 8, wherein the pressure difference between the first and second points is directly measured.

15. A centrifugal pump comprising:

a. a casing;

b. a suction nozzle for admitting fluid to the casing;

c. a driving shaft;

d. a centrifugal impeller mounted on the driving shaft within the casing;

e. a pump discharge inlet area adjacent the impeller;

f. a discharge outlet communicating with the inlet area, a cut-water and a discharge nozzle being disposed therebetween;

g. means for sensing a first pressure head at the pump discharge inlet area;

h. means for sensing a second pressure head, spaced from the means for sensing a first pressure head, at the discharge nozzle toward the discharge outlet; and i. an integral orifice plate of reduced diameter located at the pump discharge nozzle.

16. The pump of claim 15, comprising a casing volute.

17. The pump of claim 15, comprising means for comparison of data from the means for sensing the first and second pressure head with a flow constant.

18. The pump of claim 15, wherein the means for sensing a pressure head comprises sensor taps.

19. The pump of claim 18, wherein the sensor taps comprise fluid pressure sensors.

20. The pump of claim 18, wherein the sensor taps comprise passages for flow of fluid from the pump discharge inlet area and discharge nozzle.

21. The pump of claim 15, comprising means for measuring difference in pressure between the first and second pressure heads.

22. A centrifugal pump comprising:

a. a casing;

b. a suction nozzle for admitting fluid to the casing;

c. a driving shaft;

d. a centrifugal impeller mounted on the driving shaft within the casing;

e. a pump discharge inlet area adjacent the impeller;

f. a discharge outlet communicating with the inlet area, a cut-water and a discharge nozzle being disposed therebetween;

g. means for sensing a first pressure head at the pump discharge inlet area;

h. means for sensing a second pressure head, spaced from the means for sensing a first pressure head, at the discharge nozzle toward the discharge outlet; and i. an integral orifice plate of reduced diameter located at the suction nozzle.

23. The pump of claim 22, comprising a casing volute.

24. The pump of claim 22, comprising means for comparison of data from the means for sensing the first and second pressure heads with a flow constant.

25. The pump of claim 22, wherein the means for sensing a pressure head comprise sensor taps.

26. The pump of claim 25, wherein the sensor taps comprise fluid pressure sensors.

27. The pump of claim 25, wherein the sensor taps comprise passages for flow of fluid through the suction nozzle.

28. The pump of claim 22, comprising means for measuring difference in pressure between the first and second pressure heads.

* * * * *